United States Patent [19]

Olesen

[11] Patent Number: 4,666,075

[45] Date of Patent: May 19, 1987

[54] STAPLER MECHANISM

[75] Inventor: Paul Olesen, Bellmore, N.Y.

[73] Assignee: Swingline Inc., Long Island City, N.Y.

[21] Appl. No.: 860,730

[22] Filed: May 7, 1986

Related U.S. Application Data

[63] Continuation-in-part of Ser. No. 799,080, Nov. 18, 1985, abandoned.

[51] Int. Cl.[4] ..... B25C 5/02; B25C 5/11

[52] U.S. Cl. ..... 227/128; 227/120

[58] Field of Search ..... 227/120, 125, 126, 127, 227/128, 156

[56] References Cited

U.S. PATENT DOCUMENTS

| | | | |
|---|---|---|---|
| 2,279,584 | 4/1942 | Vogel | 227/126 |
| 2,603,781 | 7/1952 | Ruskin | 227/128 |
| 2,702,384 | 2/1955 | Ruskin | 227/128 |
| 2,915,753 | 12/1959 | Ruskin | 227/128 |
| 3,083,367 | 4/1963 | Ruskin | 227/127 X |
| 3,656,678 | 4/1972 | Ruskin | 227/128 |
| 4,187,971 | 2/1980 | Prew, Jr. | 227/125 |

*Primary Examiner*—Paul A. Bell

*Attorney, Agent, or Firm*—Pennie & Edmonds

[57] ABSTRACT

A small desk type stapler having a pivoted cover frame and magazine is disclosed. The magazine has a magazine slide which is retracted upon pivoting the cover frame to the open position. The slide is retracted to a position where it interconnects with a portion of the cover frame and holds the cover frame in the open position, allowing staple loading.

3 Claims, 16 Drawing Figures

10
11
12
13
15
16
21
22
23
24
25,27
26
32
34
34a
34a,35a
34a,58
34a,59
34b
35
35a,59
35b
36
38a
39
44
46
49
52
53
54
55
55,56
58
58,59
60
61
5

STAPLER MECHANISM

RELATED APPLICATION

This application is a continuation-in-part application of U.S. patent application Ser. No. 799,080, filed Nov. 18, 1985 entitled "Stapler Mechanism", now abandoned.

BACKGROUND OF THE INVENTION

Small desk type staplers have been available for many years (U.S. Pat. No. 2,702,384). A variety of techniques have been proposed for retracting the staple stick pusher during preloading of the stapler with the cover portion pivotally swung to an open-position (U.S. Pat. Nos. 3,083,367, 2,551,838, 2,603,781, and 4,187,971).

SUMMARY OF THE INVENTION

Briefly, the present invention comprises a magazine with a magazine slide and base having base pivot sections about which a cover frame is pivotal. A spring has one end connected to the slide and the other end to the cover frame. The slide has end walls and cover frame side pivot sections have surfaces such that as the cover is pivoted open, a slide end wall and a frame side pivot section surface engage under spring urging to hold the cover in the open position.

It is a feature that the cover frame carries a flexible spring element having a base connected to the frame and engageable with the base pivot sections. The flexible spring element also carries the stapler driver.

It is a further feature that the stapler has a snap-on cover.

DESCRIPTION OF THE PREFERRED EMBODIMENT

Figures 1, 2, 3, 4:
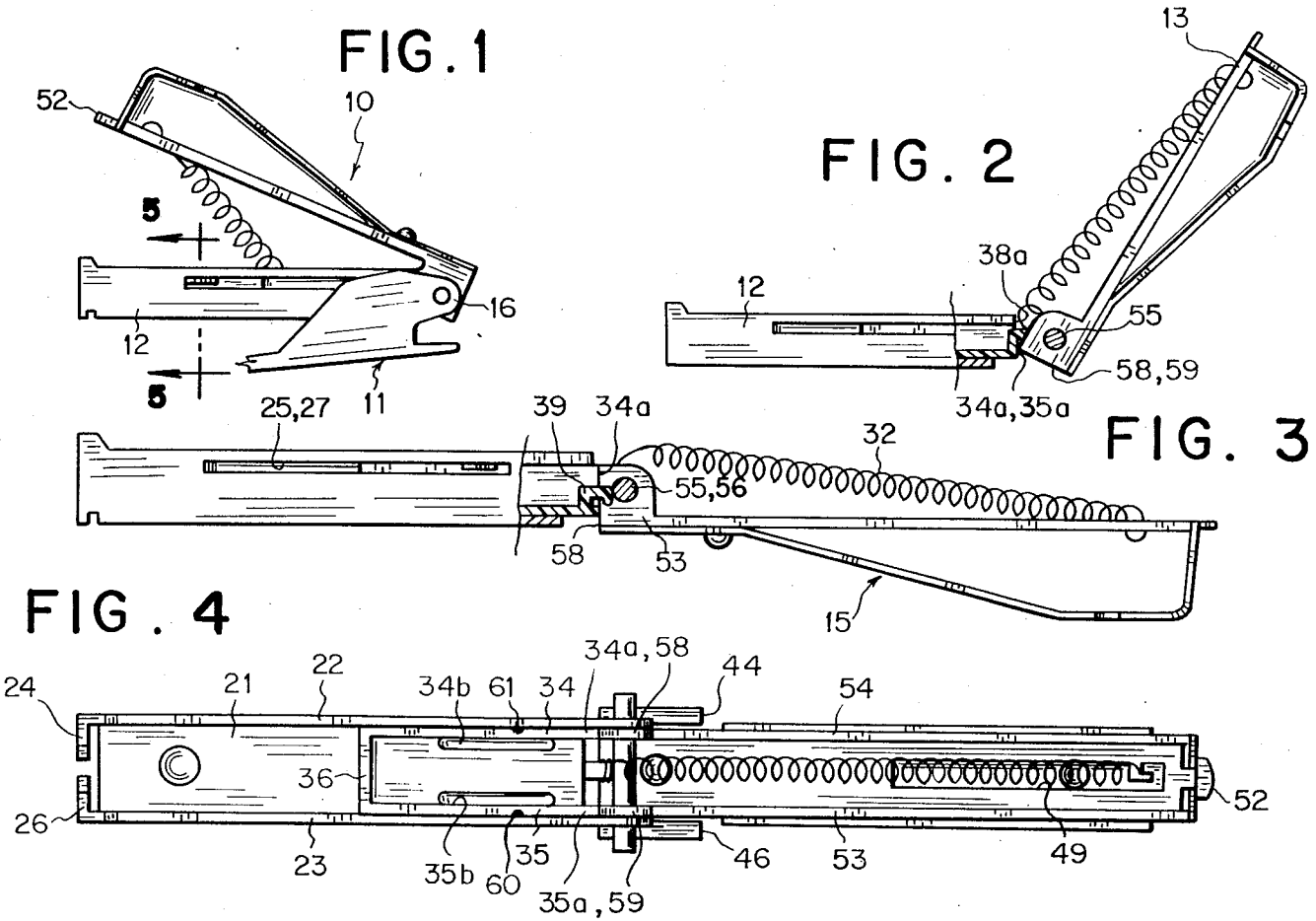
FIG. 1 is a side elevational view of the stapler partially opened with a portion of the base removed.
FIG. 2 is a side elevational view, partially sectioned, showing the staple partially opened with the base removed.
FIG. 3 is a side elevational view, partially sectioned, showing the stapler fully opened with the base removed.
FIG. 4 is a plan view of the stapler fully opened with the base removed.
Figure 5:
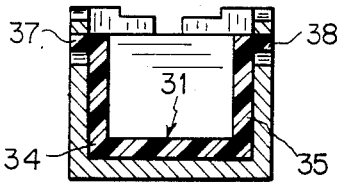
FIG. 5 is a sectional view taken along line 5—5 of FIG. 1.

In FIGS. 1–8, stapler 10 includes base 11 (FIGS. 1, 6 and 7) having magazine 12 and cover frame 13 pivotally mounted about pin 14 which is journaled in upstanding spaced-apart base ear sections 16 and 17. Base 11 includes base ear sections 16, 17, ear support portions 19, 20 and anvil portion 18. Cover frame 13 carries cover 63 as further described (FIGS. 13–16).

Magazine 12 includes staple stick support bottom 21, sides 22, 23 and upstanding notch-forming front pieces 24, 26. Sides 22, 23 have longitudinal slots 25, 27 respectively, to receive detents 28, 29 positioned on the inside of the ears 16, 17. Housed in magazine 12 is staple stick pusher 31 which is urged forward or rearward by cover spring 32. Pusher 31 includes sides 34, 35, end piece 36, slot engaging slide projections 37, 38 (see FIG. 5) and spring hook 39 (see FIG. 4). Pusher 31 includes slit openings **34*b* and 35*b***.

Cover frame 13 has driver spring 15 connected to it by rivet 40. Driver spring 15 includes horizontal base portion 41 with slot openings 42, 43 froming spring finger piece 44, 46 which rest on ear support portion 19, 20. Spring 15 also includes arm portion 47 and staple driver blade 48. Blade 48 has a rectangular opening 51 through which cover extension 52 extends. Extension 52 guides blade 48 as it is pushed down to drive a staple and thereafter moves up under spring action. All portions of spring 15 are preferably integrally formed of spring steel. Cover frame 13 has opening 49 to accommodate the spring. Cover 13 also includes side pivot sections 53, 54 which carry circular journal openings 55, 56 for rotation about pin 14. Sections 53, 54 have flat bearing surfaces 58, 59 respectively.

Turning to FIGS. 1–4, it is seen that as cover 13 is opened magazine pusher spring 32 urges the staple pusher 31 rearwardly until pusher flat end walls **34*a*, 35*a* engage flat surfaces 58, 59 of cover side pivot sections 53, 54 under spring tension to hold cover 13 in the open position (FIGS. 3 and 4). The force of spring 32 is sufficient to hold pusher end walls 34*a*, 35*a* against cover frame surfaces 58, 59 to cause cover frame 13** to remain in the open position without the operator holding it in such position. This feature facilitates loading staple sticks.

Figure 6:
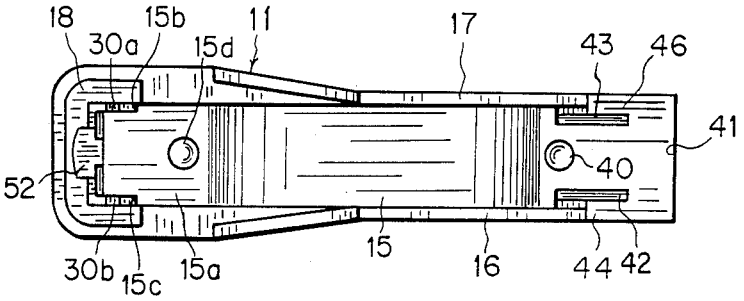
FIG. 6 is a plan view of the stapler closed.
Figure 7:
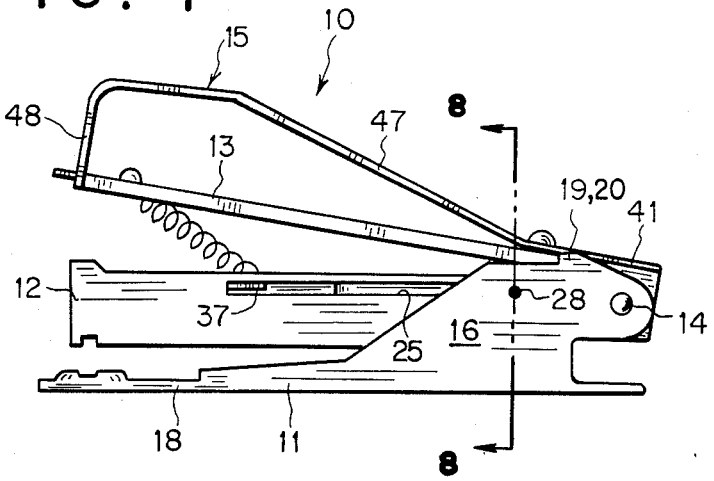
FIG. 7 is a side elevational view of the stapler.
Figure 9:
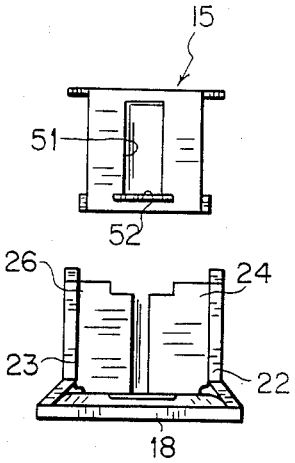
FIG. 9 is a front view of the stapler in the FIG. 7 open position.
Figure 10:
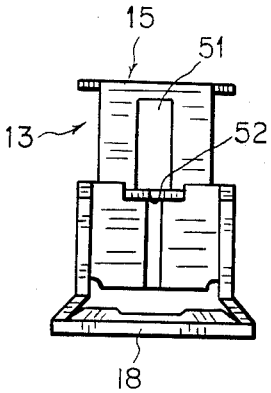
FIG. 10 is a front view of the stapler closed but in the inoperative position.
Figure 11:
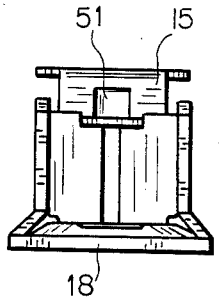
FIG. 11 is a front view of the stapler in the driving position.
Figure 12:
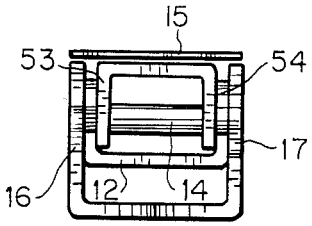
FIG. 12 is a rear view of the stapler in the FIG. 7 position.

With respect to FIGS. 5–8, magazine longitudinal openings 25, 27 carry pusher slide projections 37, 38 and detents 28, 29 respectively. Spring 15 includes crown portion **15*a* with cutout portions 30*a*, 30*b* creating narrow front edges 15*b*, 15*c* (FIG. 6). Also shown is spring crown opening 15*d***.

Figure 8:
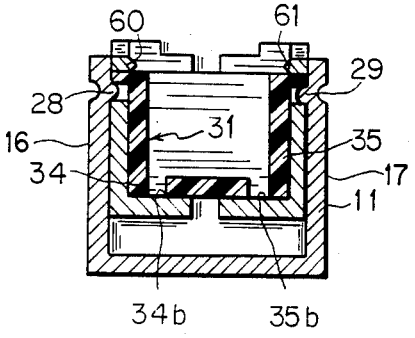
FIG. 8 is a sectional view taken along line 8—8 of FIG. 7.

In FIGS. 4 and 8, cover frame 13 is positioned in magazine 12 with blisters 60, 61 providing a forced fit between frame 13 and magazine 12.

Figure 13:
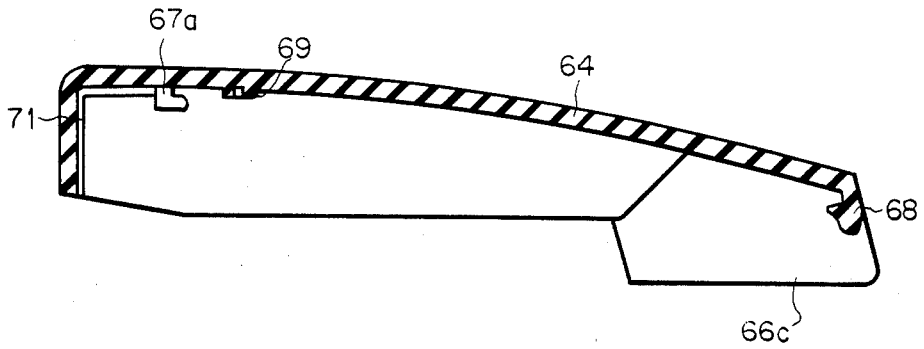
FIG. 13 is a sectional side elevational view of the stapler cover disassembled.
Figure 14:
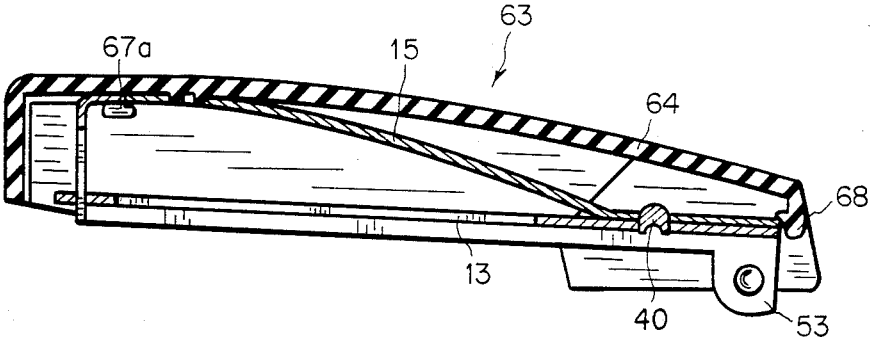
FIG. 14 is a sectional side elevational view showing the spring-frame partially assembled with the cover.
Figure 15:
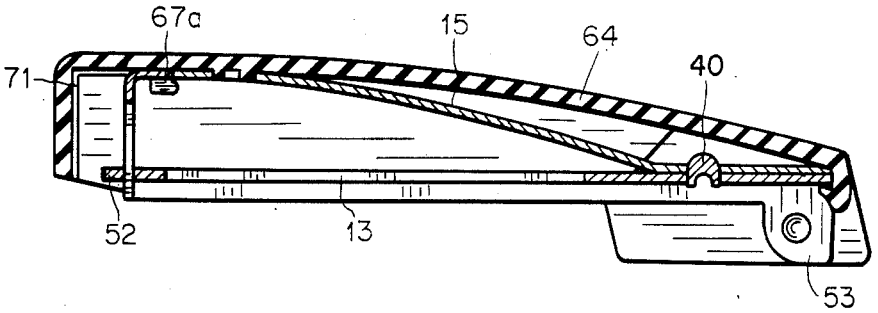
FIG. 15 is a sectional side elevational view showing the spring-frame fully assembled with the cover.
Figure 16:
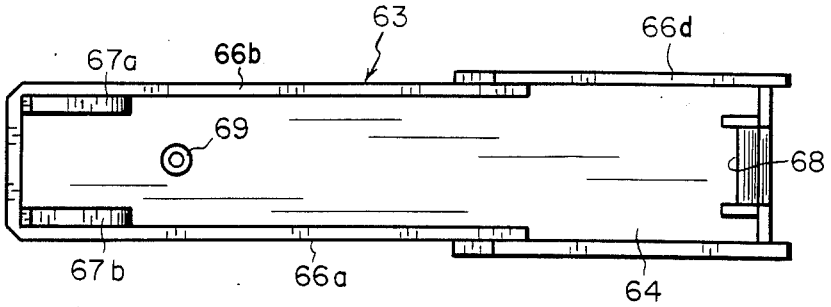
FIG. 16 is a bottom plan view of the cover.

Turning finally to FIGS. 13–16, cover 63, preferably made of moldable plastic material, includes cover top portion 64, side walls **66*a*, 66*b* including side wall skirt sections 66*c*, 66*d* (see, in particular, FIGS. 13 and 16). Cover 63 also includes forward connecting lips 67*a*, 67*b*, rear deformable connecting ledge 68 and locating button 69 for ready engagement and assembly of spring 15, cover frame 13, and cover 63**.

Forward connecting lips **67*a*, 67*b* receive the front edges 15*b*, 15*c* of spring 15 (see FIGS. 6, 14 and 15). As spring front edges 15*b*, 15*c* are urged under lips 67*a*, 67*b*, locating button 69 enters spring hole 15*d* to locate spring 15 and to prevent its rearward movement relative to cover 63 (FIG. 14). Next, cover frame 13 is pressed toward cover top 64 causing rear connecting ledge 68 to deform until frame 13 snaps into the fully engaged position shown in FIG. 15. Also shown are side pivot section 53, rivet 40, cover extension 52 and cover ribbing 71**.

It is thus seen that cover 63 can be readily assembled by "snapping" it on staple 10 without the use of tools.

I claim:

1. A stapler having a magazine, and cover frame pivotally mounted about spaced-apart base pivot sections comprising a magazine slide mounted for reciprocal movement in the magazine said magazine side having end walls;

an elongated spring with one end connected to the magazine slide and the other end connected to the cover frame;

said cover frame base pivot sections having flat surfaces which cooperate with the magazine slide end walls such that upon pivoting the cover frame from its closed position to its open position the spring will urge said magazine slide end walls into abutting relationship with the flat surfaces of the cover frame pivot sections to hold the cover frame in its open position.

2. The stapler of claim 1 in which the cover frame includes a spring metal drive element having a base drive element mounted on the cover frame and a flexible arm element wherein the base drive element has sections which engage the base pivot sections as the arm element is flexed.

3. The stapler of claim 1 which stapler includes a spring metal drive element connected to the cover frame and includes a cover having forward connecting lip means for connection to the spring metal drive element and rear deformable connecting ledge means connectable to the cover frame whereby the cover is readily assembled with the spring drive element and cover frame.

* * * * *